United States Patent [19]

Hirai et al.

[11] Patent Number: 4,924,140

[45] Date of Patent: May 8, 1990

[54] COLOR PICTURE TUBE OF SHADOW MASK TYPE WITH PARTICULAR FACEPLATE PANEL STRUCTURE

[75] Inventors: Ryoji Hirai, Mobara; Eiichi Yamazaki, Ichihara; Fumiaki Yonai, Mobara, all of Japan

[73] Assignee: Hitachi, Ltd., Tokyo, Japan

[21] Appl. No.: 158,705

[22] Filed: Feb. 22, 1988

[30] Foreign Application Priority Data

Mar. 20, 1987 [JP] Japan ..... 62-63796

[51] Int. Cl.[5] ..... H01J 31/00

[52] U.S. Cl. ..... 313/477 R; 313/402; 220/2.1 A

[58] Field of Search ..... 313/477 R, 402, 408; 220/2.1 A

[56] References Cited

U.S. PATENT DOCUMENTS

| | | | |
|---|---|---|---|
| 4,570,101 | 2/1986 | Campbell | 313/477 R |
| 4,631,439 | 12/1986 | D'Amato et al. | 313/477 R |
| 4,631,441 | 12/1986 | Morrell et al. | 313/408 |

FOREIGN PATENT DOCUMENTS

| | | | |
|---|---|---|---|
| 2136198 | 9/1984 | United Kingdom . | |
| 2136199 | 9/1984 | United Kingdom | 313/477 R |
| 2136200 | 9/1984 | United Kingdom . | |
| 2147142 | 5/1985 | United Kingdom . | |

*Primary Examiner*—Donald J. Yusko
*Assistant Examiner*—Michael Horabik
*Attorney, Agent, or Firm*—Antonelli, Terry, Stout & Kraus

[57] ABSTRACT

A color picture tube of shadow mask type includes a faceplate panel mounted on the tube. The faceplate panel has curvatures along its major and minor axes, respectively. When the outer surface contour of the faceplate panel is represented by a three-dimensional expression in the orthogonal coordinate system defined by the X-axis corresponding to the major axis, the Y-axis corresponding to minor axis, and the Z-axis corresponding to the axis of the tube, respectively, curved contours $Z_x$ and $Z_y$ of the faceplate panel along the major axis and the minor axis are so realized as to be approximated by $Z_xA_1X^2+A_2X^4$ and $Z_y=A_3Y^2+A_4Y^4$, respecvtively, where X and Y represent distances from the center of the faceplate panel along the X-axis and the Y-axis, respectively, and wherein the constants $A_1$, $A_2$, $A_3$ and $A_4$ are so selected that the conditions that $0.3 \leqq P_x(X=X_1) \leqq 0.6$ and $0.95 \leqq P_y(Y=Y_2) \leqq 1.0$ where $P_x=A_1X^2/(A_1X^2+A_2X^4)$, $P_y=A_3Y^2/(A_3Y^2+A_4Y^4)$ are satisfied at points $X_1$ and $Y_2$ on the boundaries defining an effective picture area on the faceplate. Further, the contours of the effective picture area defining boundaries extending in parallel with short and long sides of the outer surface of the faceplate panel are so curved as to have approximately equal curvature, the radius R (mm) of which on the boundary is so selected as to satisfy the condition that $1.5\ (42.5\ V+45.0) \leqq R \leqq 2.0\ (42.5\ V+45.0)$, where V represents the diagonal length of the effective picture area.

5 Claims, 10 Drawing Sheets

(UNIT : μm)

| 1/4 MODEL / TUBE | | | | | | |
|---|---|---|---|---|---|---|
| | |  |  |  |  |  |
| R = 2Ro | Px=0.3 | 65 | 76 | 74 | 109 | 75 |
| | Px=0.2 | 86 | 73 | 91 | 168 | 134 |
| R = 1Ro | | 60 | 118 | 121 | 94 | 109 |

(UNIT : μm)

| 1/4 MODEL / TUBE |  |  |  |  |  |
|---|---|---|---|---|---|
| R = 2Ro<br>Px = 0.3 | 140 | 130 | 170 | 100 | 110 |
| R = 1Ro | 90 | 160 | 180 | 70 | 110 |

FIG. 16

| R | Px | RELATIVE VALUE OF DOMING |
|---|---|---|
| 1.0Ro | 1.0 | 100 |
| 2.0Ro | 0.3 | 128 |
| 1.5Ro | 0.3 | 90 |
| | 0.6 | 127 |
| | 0.7 | 146 |

COLOR PICTURE TUBE OF SHADOW MASK TYPE WITH PARTICULAR FACEPLATE PANEL STRUCTURE

BACKGROUND OF THE INVENTION

The present invention relates in general to a color image receiving tube or picture tube of shadow mask type. More particularly, the invention is concerned with a faceplate panel of the picture tube having an improved structure.

Referring to FIG. 1 of the accompanying drawings, a color picture tube of shadow mask type is constituted by a glass envelope 4 including a rectangular faceplate panel 1, a tubular neck portion 2 and a funnel-like portion 3 for connecting together the faceplate panel 1 and the neck portion 2. On the other hand, the faceplate panel 1 is composed of a display faceplate la and an outer peripheral flange or side wall portion lb hermetically bonded to the funnel-like portion 3 by means of bonding glass having a low melting point as indicated by a reference numeral 5. A tricolor phosphor screen 6 is formed over the inner surface of the faceplate panel 1*a*.

A shadow mask 7 is mounted on the inner side of the faceplate panel 1 with a predetermined distance from the phosphor screen 6. An electron gun assembly 8 is mounted within the neck portion 2 in an in-line, triangular or delta array, wherein three electron beams 9 generated by the electron gun assembly 8 are directed toward the phosphor screen 6 through the shadow mask 7. A magnetic deflection yoke 10 is externally mounted in the vicinity of and around a junction 3 between the portion 2 and the funnel-like portion 3. By means of this yoke 10, magnetic fluxes are caused to act on the electron beams 9 in both horizontal and vertical directions, whereby the screen 6 is scanned with the electron beams 9 in the horizontal direction, i.e. along the major axis X—X and in the vertical direction, i.e. along the minor axis Y—Y so that a rectangular raster is generated on the screen 6.

Heretofore, the surface contour of the faceplate panel 1 has commonly been spherical or cylindrical. Attempts for realizing the panel surface as flat as possible has encountered various problems. First, difficulty arises in assuring a sufficient mechanical strength of the enclosure or tube. Additionally, in the shadow mask type color picture tube, there will occur a so-called doming phenomenon, that is, local dislocation or shift in color and hence deterioration in color purity. This is due to thermal expansion of the shadow mask 7 under irradiation with the electron beams 9. More specifically, when a given region of the shadow mask is heated to higher temperature than the other, a spherical bulging takes place in the given region, whereby the mask holes formed in that region are positionally displaced, as a result of which the relative position between the electron beams and the phosphor dots are correspondingly varied and thus the local color dislocation (color purity shift) is visually observed. This is the phenomenon referred to as "doming".

For having a better understanding of the invention, preparatory analysis will be made in some detail on the doming phenomenon by referring to FIGS. 2 to FIGS. 5A and 5B of the accompanying drawings, in which FIG. 2 shows in a front view the faceplate panel of the picture tube shown in FIG. 1, FIG. 3 is a fragmental sectional view of the picture tube taken along the line X—X in FIG. 2, FIG. 4 is an enlarged fragmental view of the faceplate and the shadow mask in a portion indicated as enclosed by a circle 12 in FIG. 3, and FIGS. 5A and 5B are enlarged fragmental views showing in section the screen in two different states, respectively. In the case of aspherical faceplate panel, the inner surface thereof presents a substantially spherical contour. In conformance with the spherical inner surface of the faceplate panel, the shadow mask assumes substantially a spherical curvature. As the surface profile or contour of the faceplate is caused to approximate to a flat plane, the spherical contour of the shadow mask becomes straightened approximately to a flat plane, which in turn involves angular deviation between the direction normal to a plane of the shadow mask and the direction in which the electron beam travels. In other words, the angle of incidence at which the electron beam lands the shadow mask becomes large. As the temperature of the shadow mask is increased under irradiation with the electron beam, the former is thermally expanded. As a consequence, the shadow mask is displaced in the direction normal to the plane of the shadow mask, as indicated by an arrow 14 in FIG. 4, from the solid line position 7 to a broken line position 7', as shown in FIG. 3. Correspondingly, the positions of the holes formed in the shadow mask are also displaced substantially in the direction normal to the shadow mask. At that time, an angular difference $\alpha$ makes appearance between the beam running direction 16 and the direction 14 in which the shadow mask is displaced, as is illustrated in FIG. 4. Consequently, the path 9 of the electron beam passing through a same hole in the shadow mask varies in such a manner as indicated by a broken line 9', in accompaniment to the thermal expansion of the shadow mask. This is visually observed as the dislocation of color (purity shift of color). More specifically, in the state in which no doming phenomenon takes place, the electron beam 9 can land on a center region between black matrix stripes 18, as shown in FIG. 5A, whereas it lands on at a position deviated from the center between the black matrix stripes, as indicated by 9' in FIG. 5B, upon occurrence of the doming phenomenon, giving rise to generation of the color dislocation.

Magnitude of change in the relative position between the electron beam and the phosphor dot as caused by the doming phenomenon, i.e. magnitude D of the doming can be calculated in accordance with the following expression (1):

$$D = d \cdot \tan\alpha \times \frac{(P_r + q_r)}{P_r} \quad (1)$$

where d represents a change in the hole position of the shadow mask in the direction normal thereto due to the thermal expansion of the mask, $\alpha$ represents the angle of incidence of the electron beam to the shadow mask, Pr represents a distance between the center of a deflection plane and the shadow mask as measured along the direction of beam path, and $q_r$ represents a distance between the shadow mask and the phosphor screen as measured along the beam path, as is illustrated in FIG. 3.

In case the curved surface of the shadow mask is of a simple spherical contour, the aforementioned incident angle $\alpha$ can be calculated in accordance with $$\alpha = \cos^{-1}\frac{P_r^2 - P_o^2 + 2P_oR}{2P_r \cdot R} \quad (2)$$

where R represents the radius of curvature of the spherical surface of the shadow mask, and $P_o$ represents distance between the center of deflection and the center of the shadow mask on the major axis.

Taking as an example a 21V" (90°) color picture tube known heretofore, the radius of curvature R is about 840 mm, and $P_o$ and $P_r$ are about 281.5 mm and about 306.7 mm, respectively, (as measured at a point on the shadow mask distanced from the center thereof by 150 mm). Accordingly, the angle $\alpha$ is about 18.8°.

When the radius of curvature R is increased to about 1680 mm in an attempt to flatten the spherically curved contour of the shadow mask in the color picture tube mentioned above, then $P_o$=281.5 mm and $P_r$=313.1 mm. Accordingly, $\alpha$=23.5°.

Thus, when the faceplate panel is flattened (by doubling the radius of curvature) as described above, magnitude of the doming is increased by a factor of about 1.3, as calculated in accordance with the aforementioned expression (1) on the assumption that the change of the hole position in the shadow mask is constant. However, the results of computer-aided analysis based on the so-called finite element method show that magnitude of the doming is increased at least by a factor of 2 when the radius of curvature R is doubled. It has been found that the value resulting from the computer-aided analysis approximately coincides with the data obtained from the measurement conducted by the inventors for a prototype tube manufactured for this purpose.

As will be appreciated from the foregoing, limitation is imposed on the attempt for flattening the surface contour of the faceplate panel because of the doming phenomenon. To say in another way, diminishing in the radius of curvature of the shadow mask which is effective for remedying the doming is in contradiction to the flattening of the faceplate panel.

As the picture tube known heretofore in which attempt is made to make the flattening of the faceplate compatible with reduction of the doming phenomenon, there may be mentioned a one disclosed in GB No. 2136200A, GB No. 2136198A and GB No. 2147142A. In the case of this known cathode-ray tube, the surface contour of the faceplate panel along the minor axis is so realized as to be represented by a quadratic expression, while the curvature in the center portion of the faceplate panel along the minor axis is selected greater than the curvature along the major axis.

FIGS. 6, 7 and 8 of the accompanying drawings show sections of the known faceplate panel described above, which sections are taken along the major axis X—X, the major axis Y—Y and a diagonal W—W in FIG. 2. In these figures, P represents height of the peripheral wall portion of the panel. According to the teaching disclosed in the literature cited above, there is provided a region where the quadratic expression representing the curvature along the diagonal assumes minus sign. Namely, there are provided inflexion points 22 (see FIG. 8) with a view to flattening the corner surface regions of the faceplate.

The above faceplate panel however suffers problems mentioned below. First, reflection of ambient illumination on the faceplate panel surface presents a problem although it depends on the design of the curved surface contour of the faceplate. More specifically, because of the presence of the inflexion points in the corner regions of the faceplate panel, ambient light image reflected thereon undergoes distortion in the region covering the inflexion point. For example, ambient light image of a lattice pattern will be distorted in such a manner as illustrated in FIG. 9 upon being reflected on the faceplate panel, to discomfort to the viewer. As the area of the region where the quadratic equation representing the curvature along the diagonal assumes a minus sign (i.e. inflexion point covering region 22) is increased, the mechanical strength of the shadow mask is reduced and becomes more susceptible to thermal deformation. In view of the fact that there exists a correlation between the doming phenomenon and the contour of the boundary portion defining the effective picture area of the faceplate, difficulty will be encountered in remedying the doming phenomenon. In other words, when the effective picture area defining boundary portion (region covering the point 22 in FIG. 8) is flattened so that the faceplate may look flat, then the doming phenomenon is more likely to take place, to another problem.

SUMMARY OF THE INVENTION

Accordingly, it is an object of the present invention to provide a color picture tube of shadow mask type provided with a face plate panel which looks flat and is capable of minimizing color dislocation (purity shift) due to the doming phenomenon, to thereby overcome the shortcomings of the prior art color picture tube described above.

In view of this object, there is provided according to an aspect of the present invention a color picture tube of shadow mask type which includes a faceplate panel mounted on the tube, the faceplate panel having curvatures along its major and minor axes. When the outer surface contour of the faceplate panel is represented by a three-dimensional expression in the orthogonal coordinate system defined by the X-axis corresponding to the abovementioned major axis, the Y-axis corresponding to abovementioned minor axis, and the Z-axis corresponding to the axis (Z—Z) of the tube, respectively, curved contours $Z_x$ and $Z_y$ of the faceplate panel along the major axis and the minor axis are so realized as to be approximated by $Z_x=A_1X^2+A_2X^4$ and $Z_y=A_3Y^2+A_4Y^4$, respectively, where X and Y represent distances from the center of the faceplate panel along the X-axis and the Y-axis, respectively, wherein the constants $A_1$, $A_2$, $A_3$ and $A_4$ are so selected that the conditions that $0.3 \leqq P_x(X=X_1) \leqq 0.6$ and $0.95 \leqq P_y(Y=Y_2) \leqq 1.0$ where $P_x=A_1X^2/(A_1X^2+A_2X^4)$, $P_y=A_3Y^2/(A_3Y^2+A_4Y^4)$ are satisfied at points $X_1$ and $Y_2$ on the boundaries defining an effective picture area on the faceplate. $P_x$ is any point on the X axis wherein Y=0 and $P_y$ is any point on the Y axis where X=0. Further, the contours of the effective picture area defining boundaries extending in parallel with short and long sides of the outer surface of the faceplate panel are so curved as to have approximately equal curvature, the radius R (mm) of which curvature at the boundary is so selected as to satisfy the condition that $1.5\,(42.5V+45.0) \leqq R \leqq 2.0\,(42.5V+45.0)$, where V represents the diagonal length of the effective picture area.

By selecting the values of $P_x$, $P_y$ and R within the respective ranges defined above, the doming phenomenon can be suppressed to a minimum, while the mechanical strength and surface reflection of the faceplate panel can be improved with the flatness thereof being enhanced.

BRIEF DESCRIPTION OF THE DRAWINGS

FIG. 16 is a view showing the results of the analysis conducted for the doming in a variety of faceplate panels.

DESCRIPTION OF THE PREFERRED EMBODIMENTS

Figure 1:
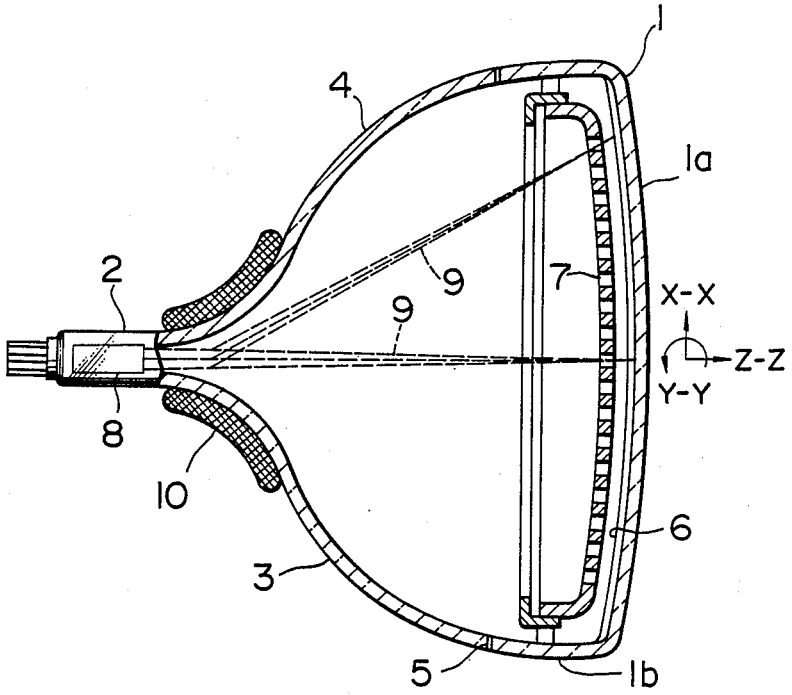
FIG. 1 is a view showing in section a tri-color picture tube of a shadow mask type.

In the following, an exemplary embodiment of the color picture tube according to the present invention will be described in detail by referring to the drawings.

Figure 10:
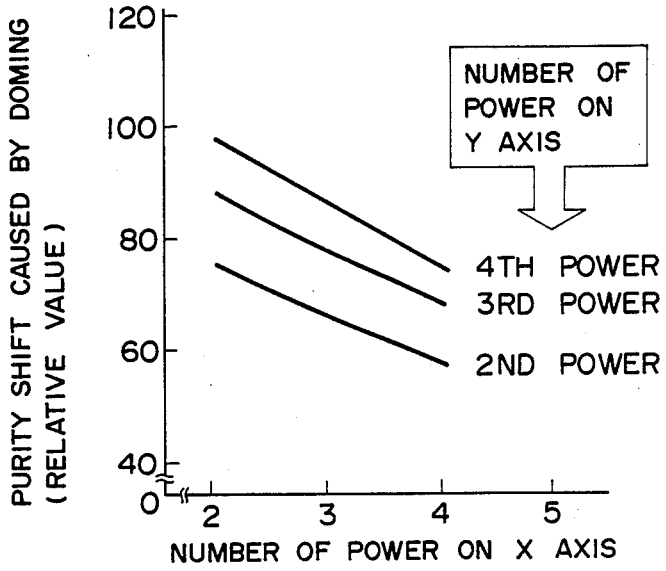
FIG. 10 is a view for graphically illustrating the results of analysis of the doming phenomena in faceplate panels.

FIG. 10 shows graphically the results of analysis conducted by the inventors concerning the doming phenomenon in faceplate having a spherical surface contour. As will be seen in this figure, the doming phenomenon can be mitigated by implementing the faceplate panel with such curved surface that the curvature thereof along the minor axis can be given by a quadratic expression (i.e. the curvature includes 2nd power components) while the curvature along the major axis is given by a quadratic expression (including 4th power components).

Further, the inventors conducted the analysis of the doming phenomenon in a variety of faceplate panels having different aspherical surface contours in accordance with the finite element method and additionally studied the mechanical strength of the faceplate panels as well as the tolerance range of the ambient image reflection on the panel surface and the flatness thereof. The results of the analysis and the study show that the faceplate panel for a color picture tube has optimal surface curvatures in a certain range, as described below.

Figure 2:
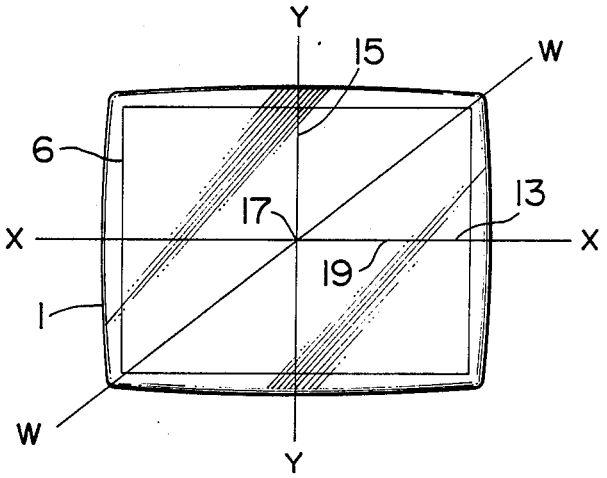
FIG. 2 is a front view of faceplate panel of the picture tube shown in FIG. 1.

In consideration of rotational symmetry, the curved surface contour of a faceplate panel can be approximately represented by the expression which includes both quadratic (2nd power) and quartic (4th power) components in combination, as follows:

$$Z=A_1X^2+A_2X^4+A_3Y^2+A_5X^2Y^2+A_6X^4Y^2+A_4Y^4+A_7X^2Y^4+A_8X^4Y^4 \quad (3)$$

where X and Y represent, respectively, the distances from the center of the faceplate panel along the X-axis and Y-axis shown in FIG. 2. Accordingly, the curved surface contour $Z_x$ along the major axis can be approximated by the following expression:

$$Z_x=A_1X^2+A_2X^4$$

On the other hand, the curved surface contour along the minor axis can be approximated by $$Z_y=A_3Y^2+A_4Y^4$$

Defining that $$P_x=A_1X^3/(A_1X^2+A_2X^4), \text{ and}$$

$$P_y=A_3Y^2/(A_3Y^2+A_4Y^4),$$

the doming phenomena were experimentally analyzed for several typical values of $P_x$ $P_y$ and the radii of curvature R (mm). The results mentioned below are obtained.

Figure 11:
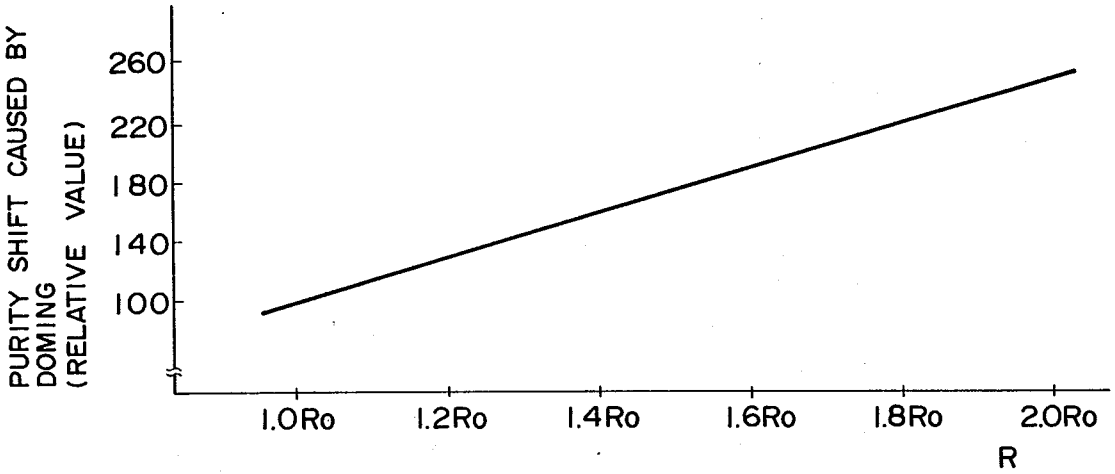
FIG. 11 is a view for graphically illustrating the results of analysis concerning relations between the radii of curvature of the faceplate surface contour and magnitude of the doming.
Figure 12:
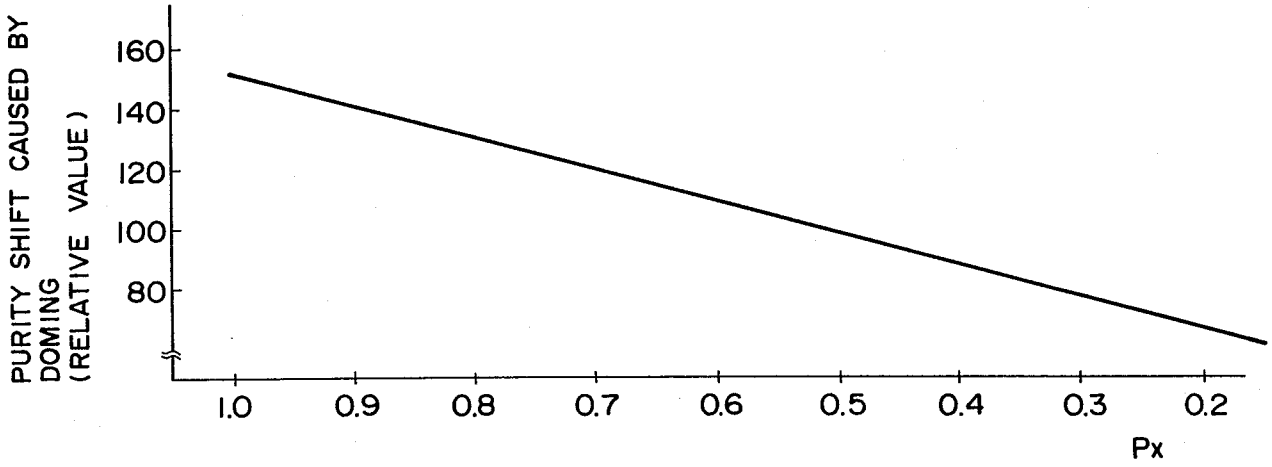
FIG. 12 is a view for graphically illustrating the results of analysis conducted for determining relations between a quantity $P_x$ and magnitude of the doming.

FIG. 11 illustrates graphically the results obtained from the analysis made on the relation between magnitude of the doming (given in terms of relative color purity shift) and the radii of curvature at boundary portions (peripheral portions) defining an effective image area of the faceplate panel. FIG. 12 is a view showing the results of the analysis made on the relation between the quantity $P_x$ defined above and magnitude of the doming. In both of these figures, the relative values of the doming are measured in the vicinity of a point 19 (see FIG. 2) on the faceplate panel which point is located on the major axis between the center point 17 (FIG. 2) and a point 13 located near the peripheral edge or boundary of the effective picture area with a distance at about $\frac{2}{3}$ from the center 17, as is shown in FIG. 2. As can be seen in FIGS. 11 and 12, magnitude of the doming is substantially in proportion to the radius of curvature and in inverse proportion to the quantity $P_x$ in the region near the point 19 (FIG. 2) on the major axis of the faceplate panel, which point is spaced from the center 17 of the faceplate with the distance at about $\frac{2}{3}$ from the center. In FIG. 11 $R_o$ represents a reference radius of curvature which is given by 42.5 V+45 where V (inches) represents the diagonal length of the effective picture area of the faceplate.

In general, so far as the radius of curvature R at the boundary portion of the effective picture area of the faceplate lies within a range given by $R<1.5\ R_o$, the doming presents practically no serious problem. However, in this case, flatness of the faceplate panel can not be realized to any satisfactory degree. On the other hand, when $R>2.0\ R_o$, the doming phenomenon becomes significant with the mechanical strength and the surface reflection property of the panel being more problematic, although the flatness of the faceplate panel can be improved adequately.

Accordingly, the radius of curvature R should preferably be selected to fall within a range given by $1.5R_o<R<2.0R_o$ (where $R_o=4.5\ V+45$). Thus, in the boundary (peripheral) portion of the effective picture area, the value of the radius of curvature in the range defined above should be employed to impress the flatness of the faceplate panel most effectively to the viewer.

On the other hand, when the quantity $P_y$ defined hereinbefore lies in a range given by $P_y<0.95$ on the boundary portions defining the effective picture area, there arises the problem that the doming phenomenon can no more be mitigated adequately. It has been experimentally established that the value of $P_y$ should preferably be selected such that $0.95<P_y<1.0$.

Accordingly, the range of values which $P_x$ can assume is determined on the basis of the values of R and $P_y$ within the respective ranges mentioned above in consideration of the panel flatness, the doming and the surface reflection.

Figure 13:
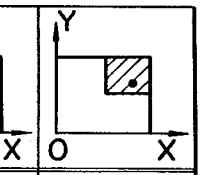
FIG. 13 is a view showing the results of analysis conducted for the doming phenomena in a variety of color picture tubes.
Figure 13:
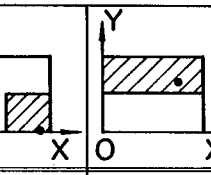
Figure 13:
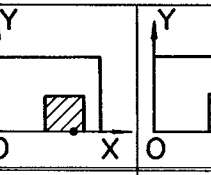
Figure 13:
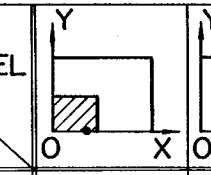
Figure 13:
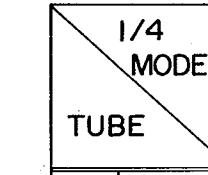

FIG. 13 is a view showing the result of analysis of the doming phenomena in various regions of the faceplate panel, the analysis being performed through simulation based on the finite element method.

Figure 14A:
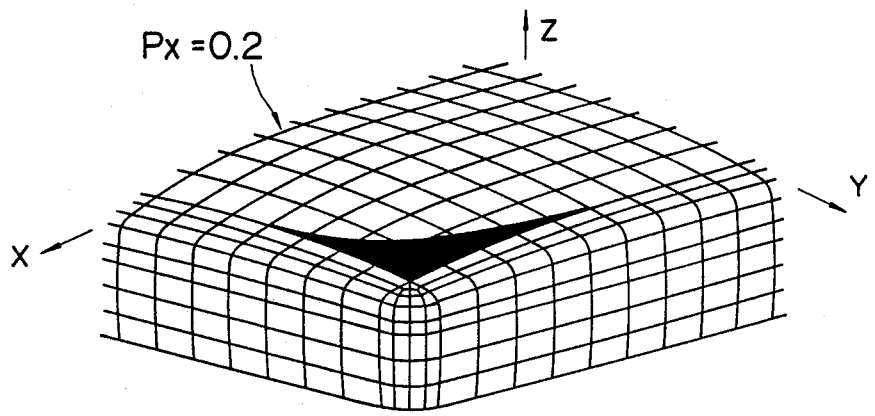
FIGS. 14A and 14B are views showing in three-dimensional schematic diagrams a $\frac{1}{4}$-scaled model faceplate panel.
Figure 14B:
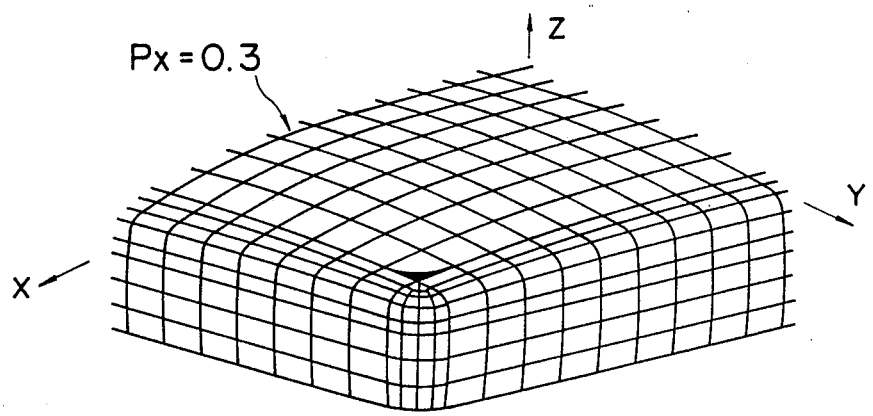

In this analysis, it is assumed that the model is a 27 V" square screen tube in which $R=2R_o$ and $P_y=0.99$, where the values of $P_x$, $P_y$ and R are determined at points in the vicinity of the effective picture area defining boundary. Further, in this simulation-based analysis, a model faceplate in a size of ¼ of that of the abovementioned tube is prepared and regions indicated by hatching are heated to raise the temperature by 15° C., wherein magnitudes of the doming (in μm) at points indicated by black points (·) in FIG. 13 where the doming phenomenon makes appearance most significantly are determined. As will be seen in FIG. 13, the doming phenomenon is most significant in the corner regions of the faceplate panel when $P_x=0.2$ as compared with the case where $P_x=0.3$. This can be explained by the fact that the region in which the derivative of second order of the curvature along the diagonal assumes minus sign in the corner portion (i.e. the black region shown in FIG. 14A) is of a large area when $P_x=0.2$. Consequently, the reflected image on the faceplate in this region will be distorted remarkably, to discomfort of the viewer.

On the other hand, when $P_x=0.3$, the area of the corner region in which the derivative of second order of the curvature along the diagonal assumes minus sign is decreased i.e. black region shown in FIG. **14*b***) Consequently, the doming phenomenon becomes less significant. Further, the surface reflection is decreased to a level presenting no remarkable eyesore.

Additionally, FIG. 13 shows that when $P_x=0.3$, magnitude of the doming is substantially same as to that of the tube in which $R=1R_o$.

Figure 15:
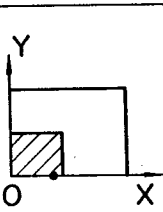
FIG. 15 is a view showing the results of measurement of the doming in a faceplate panel.
Figure 15:
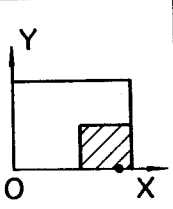
Figure 15:
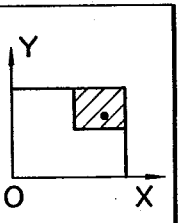

FIG. 15 shows the results of measurement of the doming phenomenon in a faceplate panel of a picture tube manufactured as the prototype in which $P_x=0.3$. The results show that the doming in the panel corner regions is equivalent in a more or less degree to that of the tube in which $R\doteq 1R_o$. Further, the maximum values of the doming at individual different locations on the faceplate panel are advantageously smaller than those in the tube in which $R=1R_o$.

From the above, it is safe to say that the minimum critical value of $P_x$ should preferably be 0.3.

Parenthetically, the values of $A_1$ to $A_8$ of the expression (3) in the 27 V" square screen tube where $R=2.0R_o$, $P_y=0.99$ and $P_x=0.3$ are as follows:

$$A_1=1.232599\times 10^{-4}$$

$$A_2=3.933428\times 10^{-9}$$

$$A_3=5.319754\times 10^{-4}$$

$$A_5=2.843446\times 10^{-9}$$

$$A_6=-9.845085\times 10^{-14}$$

$$A_4=1.306533\times 10^{-10}$$

$$A_7=-4.413865\times 10^{15}$$

$$A_8=3.264017\times 10^{-19}$$

As the value of R becomes smaller than $2R_o$, the doming and the surface reflection in the corner region becomes less significant. Further, it is noted that in this case, the doming is mitigated over the whole surface of the faceplate panel. Accordingly, by analytically determining the value of the doming at a point on the X-axis near the center of the panel for the individual values of $P_x$ in the case $R=1.5R_o$, the maximum critical value of $P_x$ can be determined.

FIG. 16 shows magnitudes of the doming on the X-axis in the vicinity of the center of the faceplate panel which are estimated on the basis of the data shown in FIGS. 11 and 12. More specifically, in FIG. 16, the domings of concern are given in terms of relative value on the assumption that the doming in the case where $R=1R_o$, $P_x=1.0$ and $P_y=0.99$ is represented by 100%. The values of P, $P_x$ and $P_y$shown in FIG. 16 are determined at points located near the effective picture area defining boundary.

When the permissible value of the doming in terms of the relative value defined above is 130, the permissible maximum value of $P_x$ is 0.6 when $R=1.5R_o$.

Figure 3:
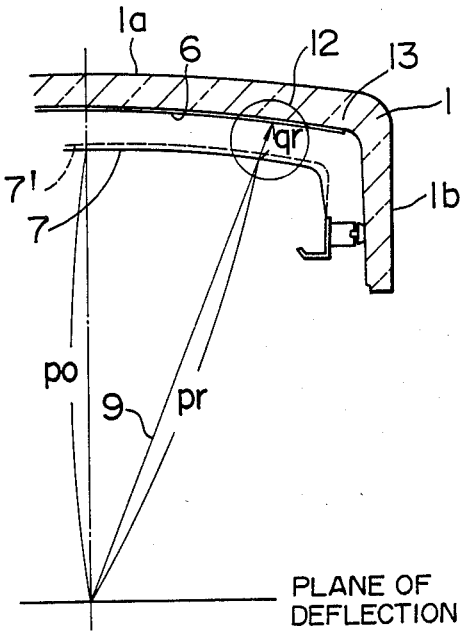
FIG. 3 is a view showing a section taken along the line X—X in FIG. 2.
Figure 4:
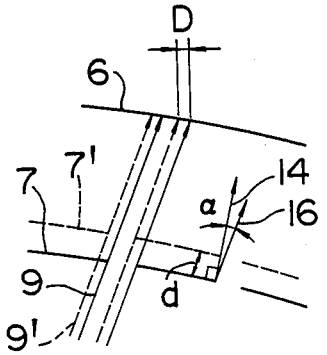
FIG. 4 is an enlarged view showing a portion enclosed by a circle 12 in FIG. 3.
Figure 5A:
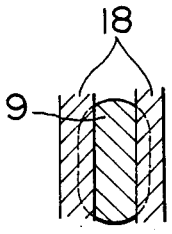
FIGS. 5A and 5B are fragmental enlarged views showing a portion of a phosphor screen surface in different states, respectively.
Figure 5B:
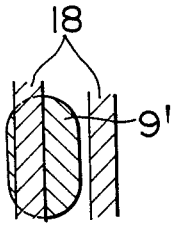
Figure 6:
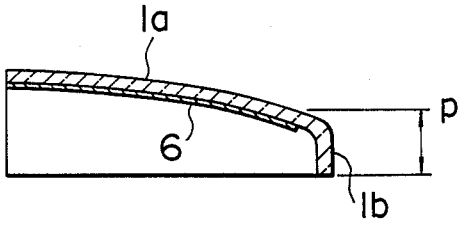
FIGS. 6, 7 and 8 are views showing a hitherto known faceplate panel in sections taken along lines corresponding to X—X, Y—Y and W—W shown in FIG. 2, respectively.
Figure 7:
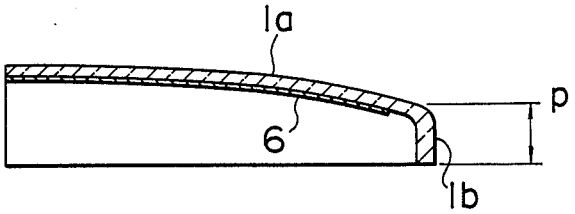
Figure 8:
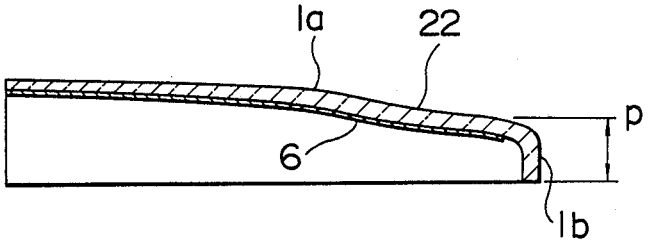
Figure 9:
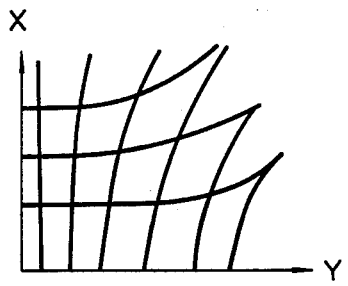
FIG. 9 is a view showing, by way of example, an ambient light image reflection on the hitherto known faceplate panel.

From the results of the analyses described above, it has been established that the range for the optimal surface contour of the faceplate panel can be defined as follows:

(i) Curved surface contour along the major axis:

The optimum contour can be realized when constants $A_1$ and $A_2$ appearing in the expression (3) satisfy the condition that $0.3\leqq P_x\leqq 0.6$ where $P_x=A_1X^2/(A_1X^2+A_2X^4)$ for a point ($X=X_1$) on the effective picture area defining boundary (i.e. point close to the point 13 in FIGS. 2 and 3).

(ii) Curved surface contour along the minor axis:

The optimum contour can be realized when constants $A_3$ and $A_4$ appearing in the expression (3) satisfy the condition that $0.95\leqq P\leqq 1.0$ where $P_y=A_3Y^2/(A_3Y^2+A_4Y^4)$ for a point ($Y=Y_o$) located on the effective picture area defining boundary (i.e. point in the vicinity of the point 15 shown in FIG. 2).

(iii) Flatness of the faceplate panel.

Concerning the flatness of the faceplate panel, it has been found that the most preferred results have been obtained when the surface contours on the short and long boundary sides defining the effective picture area are curved with substantially same curvature and when the radius of the curvature on the effective picture area defining boundary lies in the range defined below:

$$1.5(42.5V+45) \leqq R \leqq 2(42.5V+45)$$

where V (inches) represents the length of the diagonal of the effective picture area.

The ranges of the constants $A_1$, $A_2$, $A_3$ and $A_4$ described above in the paragraphs (i) and (ii) coincides with the range determined in consideration of the permissible ranges of the mechanical strength of the faceplate panel and the surface reflection.

When $P_x<0.3$, the doming phenomenon can be diminished. However, the mechanical strength of the faceplate panel and the surface reflection present problems in practical application. Further, peculiar doming phenomena tend to take place in the corner regions of the faceplate panel, involving another problem. On the other hand, when $P_x>0.6$, the doming can not effectively be remedied. Besides, difficulty will arise to ensure the flatness mentioned in the paragraph (iii) in practical application.

On the other hand, when considering the flatness of the faceplate panel, the doming phenomenon in the aspherical faceplate panel presents practically no material problem when $R<1.5$ (42.5 V+45). When $R>2(42.5\ V+45)$, asphericity is very remarkable even the conditions (i) and (iii) are satisfied in design, presenting problems concerning the strength of the faceplate panel and the surface reflection.

As will now be appreciated from the foregoing description, the present invention brings about excellently advantageous effects in respect to the reduction of the doming phenomenon, improvement of the panel strength, the surface reflection and the flatness of the faceplate panel.

Parenthetically, the shadow mask can be implemented substantially in a same configuration as the faceplate panel.

In the color picture tube of shadow mask type according to the invention, faceplate panel has a curvature along its major axis differing from that along its minor axis, wherein the curvatures along the edges of the faceplate panel extending in parallel with the major axis are smaller at the sides of the panel than the curvature along the minor axis at the sides of the panel, and the curvature in each of planes parallel to the minor axis is greater at the side of the panel than near the major axis thereof.

We claim:

1. A color picture tube of shadow mask type, including a faceplate panel mounted on said tube, said faceplate panel having curvatures along its major and minor axes;

wherein when outer surface contour of said faceplate panel is represented by a three-dimensional expression of a space defined by X-axis corresponding to said major axis, Y-axis corresponding to said minor axis and Z-axis corresponding to the axis of said tube, respectively, contour Zx of said panel along said major axis is so implemented as to be approximated by $Zx=A_1X^2+A_2X^4$ and contour Zy of said panel along said minor axis is so implemented as to be approximated by $Zy=A_3Y^2+A_4Y^4$, where X and Y represent distances from the center of said faceplate panel along said X-axis and said Y-axis, respectively, and Zx and Zy represent distances of said outer surface contour of said faceplate panel along said X-axis and Y-axis from the center of said panel to Z-axis direction, respectively, and where constant $A_1$ and $A_2$ are so selected such that a condition $0.3 \leqq Px(X=X_1) \leqq 0.6$ where $Px=A_1X^2/(A_1X^2+A_2X^4)$ is satisfied at a point $X=X_1$ and $Y=0$ which is on boundary defining an effective picture area on said faceplate and constants $A_3$ and $A_4$ are so selected such that a condition $0.95 \leqq Py\ (Y=Y_2) \leqq 1.0$ where $Py=A_3Y^2/(A_3Y^2+A_4Y^4)$ is satisfied at a point $X=0$ and $Y=Y_2$ which is on boundary defining an effective picture area on said faceplate; and wherein the contours of said effective picture are defining boundaries extending in parallel with short and long sides of the outer surface of said faceplate panel are so curved as to have an approximately same curvature, the radius R(mm) of said curvature at said boundary being so selected as to satisfy the condition that $1.5\ (42.5\ V+45.0) \leqq R \leqq 2.0\ (42.5\ V+45.0)$ where V represents the diagonal length (inch) of said effective picture area.

2. A color picture tube according to claim 1, including a shadow mask mounted within said tube, said shadow mask having a substantially same configuration as that of said faceplate panel.

3. A color picture tube according to claim 1, wherein said faceplate panel has curvatures along its major and minor axes, which curvatures differ from each other.

4. A color picture tube according to claim 1, wherein the curvature along the effective picture area defining boundary extending in parallel with said major axis is smaller than the curvature along the effective picture area defining boundary extending in parallel with said minor axis.

5. A color picture tube according to claim 1, wherein the curvature in each of planes parallel to the minor axis is greater at the side of said panel than near the major axis thereof.

* * * * *